United States Patent [19]

Hall

[11] 4,411,640

[45] Oct. 25, 1983

[54] APPARATUS FOR THE PRODUCTION OF CIGARETTE FILTER TIPS HAVING MULTI-SECTIONAL CONSTRUCTION

[75] Inventor: Floyd V. Hall, Durham, N.C.

[73] Assignee: Liggett Group Inc., Montvale, N.J.

[21] Appl. No.: 223,392

[22] Filed: Jan. 8, 1981

[51] Int. Cl.[3] ..... A24C 5/50

[52] U.S. Cl. ..... 493/45; 493/46; 493/47; 222/221

[58] Field of Search ..... 493/45, 46, 47, 48, 493/49; 83/490, 329, 330, 356.3; 131/341, 342; 222/216, 217, 218, 221; 198/726

[56] References Cited

U.S. PATENT DOCUMENTS

| | | | |
|---|---|---|---|
| 2,370,325 | 2/1945 | Ranney | 198/726 |
| 2,547,516 | 4/1951 | Zeun | 222/221 |
| 3,259,029 | 7/1966 | Hall | 493/47 |
| 3,267,821 | 8/1966 | Rowlands | 493/45 |
| 3,357,321 | 12/1967 | Hall | 493/47 |
| 4,063,494 | 12/1977 | Hall | 93/77 FT |
| 4,090,424 | 5/1978 | Hall | 83/330 |
| 4,184,412 | 1/1980 | Hall | 93/1 C |
| 4,259,130 | 3/1981 | Lebet | 156/180 |

*Primary Examiner*—Nicholas P. Godici
*Assistant Examiner*—Kurt C. Rowan
*Attorney, Agent, or Firm*—Kenyon & Kenyon

[57] ABSTRACT

The apparatus is provided with a cutter having pairs or rotary knives for cutting a filter rod into plural filter plugs and a pin wheel for positively ejecting the filter plugs in spaced array onto a conveyor. The apparatus also has a rotary feed means for the granular filter material which employs an independently rotatable cam wheel with pins for pushing out the plungers of the feed wheel to expel the charges of granular filter material. The garniture also laterally compresses the filter plugs to form a restricted pocket between two filter plugs to receive the granular filter material.

17 Claims, 8 Drawing Figures

11
28
29
31
30
8
8
13
55
53
58
59
60
18
64
68
63
61
16
68
62
60
20
30
56
57
57
56
57
57
53
63

APPARATUS FOR THE PRODUCTION OF CIGARETTE FILTER TIPS HAVING MULTI-SECTIONAL CONSTRUCTION

This invention relates to an apparatus for the production of cigarette filter tips having multi-sectional construction.

Heretofore, various types of apparatus have been known for making multi-sectional filter tips for cigarettes. For example, U.S. Pat. No. 3,357,321 describes one type of apparatus wherein fibrous filter elements are cut from a filter rod and conveyed on a strip of mouthpiece paper under an injection mechanism where charges of adsorptive-type granular filter material are injected between the filter elements. The apparatus also has means for wrapping the mouthpiece paper about the filter elements and filter material to form a continuous rod and means for cutting the formed rod into plug lengths sufficient to form for example six cigarette filters of multi-sectional construction, e.g. with a chamber of granular filter material between two sections of fibrous filter material. However, such an apparatus has a limited output of, for example 500 6-up plugs.

Generally, the output of these machines have been limited by the speed of cutting the filter rod into individual filter elements. Usually, the cutters which have been used have two cutting knives which are mounted in diametrically opposed relation on a rotatable mounting shaft which is operable at a maximum speed of about 1500 revolutions per minute (rpm). Thus, for each cycle of the cutter, two filter elements are cut so that the maximum output of the cutter is about 3,000 filter elements per minute.

The output of the apparatus has also been limited by the speed at which adsorptive-type filter material can be discharged from the injection mechanism. Heretofore, the injection mechanism has been constructed with a wheel wherein individual charges of granular filter material can be received in circumferentially spaced chambers and discharged via plungers which are activated by a reciprocating hammer. However, if the charges of granular filter material were expelled from such a wheel at high speed to accomodate a higher output the filter material would blast into the space defined between spaced apart filter elements at such a speed as to cause shattering of some of the individual particles of the filter material. As a result, after the filter plug has been made, the shattered pieces of filter material would tend to settle. Thus, when a filter is subsequently attached to a tobacco column, there would be a looseness of the granular filter material within the filter tip. This would mean that the chamber in which the granular filter material is disposed is not fully packed. Thus, smoke which would pass through the filter material adjacent to the tobacco column would pass through a void area within the granular filter material section without coming in effective contact with the granular filter material.

Expelling of the granular filter material from a wheel also poses another problem since the cross-section of the space between two spaced apart fibrous filter elements is circular. Thus, when the charge of granular filter material is received, the entire cross-section of the space may not be fully occupied. In order to avoid this, the wheel comes into contact with the filter elements to slightly flatten the elements from their original circular form. This momentary deforming and flattening is to produce a seal between the filter elements and the rim of the wheel sufficient to avoid uncontrolled escape of the granular material as the granular material is expelled into the space between adjacent filter elements. Thereafter, the filter elements and wheel separate so that the filter elements return to their original circular configuration. However, in this case, there may be a slight space above the level of the injected granular material. The size of this space is subsequently enlarged due to settling of any of the shattered pieces of the filter material.

Accordingly, it is an object of the invention to provide an apparatus for the production of cigarette filter tips having multi-sectional construction at relatively high output.

It is another object of the invention to deliver cut filter elements in a filter tip making apparatus at relatively high speeds.

It is another object of the invention to deliver plugs of filter material at a speed of about 6,000 plugs per minute to a filter tip making apparatus.

It is another object of the invention to eliminate the shattering of granular adsorptive-type filter material in the manufacture of multi-sectional filter tip assemblies.

It is another object of the invention to provide multi-sectional plugs for filter tips which have fully packed granular material sections.

It is another object of the invention to avoid voids in the granular filter material sections of a multi-sectional filter tip assembly.

Briefly, the invention provides an apparatus for the high speed production of cigarette filter tips having multi-sectional construction. The apparatus has a cutting means for cutting a delivered rod of filter material into disparate plugs of filter material, a conveyor for receiving and conveying the cut plugs from the cutting means, means for spacing the plugs on the conveyor and a second conveyor having an endless belt for receiving and conveying a strip of mouthpiece paper with the spaced plugs along a predetermined path. In addition, the apparatus has a garniture with a first section for forming the belt and mouthpiece paper into a U-shape, a following neck-down section for laterally compressing the plugs and a folding section for forming the strip of mouthpiece paper into an overlapped tube.

The apparatus also has a feed means above the second conveyor and the neck-down section of the garniture for feeding granular adsorptive-type filter material into each determinate space between successive plugs of filter material on the belt. This feed means includes a rotatably mounted wheel which has a plurality of circumferentially spaced radial chambers for receiving the granular filter material e.g. from a hopper, a plurality of plungers, each of which is slidably mounted in a respective chamber and a cam wheel which is rotatably mounted on an axis parallel to the axis of the wheel. The cam wheel has a plurality of circumferentially spaced pins for sequentially engaging the plungers to push the plungers into the respective chambers in order to expel the filter material therein at a point above the neck-down section of the garniture into the spaces between the moving filter plugs.

The apparatus also has a sealing means for sealing the overlapped strip of mouthpiece paper on itself in order to form a rod-shaped assembly of alternating sections of filter material plugs and granular filter material. In addition, the apparatus has a second cutting means for severing the rod-shaped assembly into filter plugs of determinate length. These filter plugs are hereinafter referred to as a six-up plug. However, these plugs may also be two-up or four-up plugs.

The cutting means for cutting the rod into individual plugs of filter material is constructed with at least one group of co-extensive parallel knives for cutting the rod simultaneously to form a multiplicity of cut plugs of filter material. In this respect, the knives may be formed of pairs of rotary cutting knives which are mounted about a rotatable shaft so that for each revolution of the shaft, four plugs can be cut from the delivered rod.

The cutting means cooperates with a reciprocal ledger which receives the rod of filter material at one end and delivers the severed plugs at an opposite end. At one intermediate point, the ledger has an opening for passage of the filter rod and the rotary knives so that the knives can cut the rod. The severed plugs are pushed by the trailing plugs and rod to a forward end of the ledger for expelling. In addition, a rotatable pin wheel having radially projecting pins is positioned at the forward end of the ledger for sequentially engaging and ejecting the plugs onto the first conveyor in spaced apart relation.

In one embodiment, the first conveyor is formed with a perforated end-less belt which passes over a vacuum chamber so that the severed plugs are maintained in position during travel thereon. In addition, the means for spacing the plugs of filter material on the vacuum conveyor includes a rotable drum which is positioned above the two conveyors and which has at least one flight for pushing the plugs from the first conveyor onto the second conveyor. In addition, a trough is located between the two conveyors for guiding the plugs under the drum. This trough has a narrowed section for engaging and slowing the movement of the plugs on the first conveyor prior to entry onto the second conveyor. The slowing of the plugs also causes the plugs to positively engage against the flight on the drum so that the flight positively spaces the plugs in accurate spaced apart relation immediately prior to placement on the second conveyor.

In another embodiment, the first conveyor includes a bottom support and a pair of horizontally disposed endless belts. These belts serve to convey the cut plugs therebetween and along the bottom support in spaced relation. In addition, the means for spacing the plugs includes a vertically disposed endless belt which is aligned with the bottom support and which has a plurality of spaced apart pushers for pushing the cut plugs from the bottom support onto the second conveyor in predetermined spaced relation. In this embodiment, means are provided for driving the horizontally disposed belts and the vertically disposed belt in timed relation to each other.

In order to move the pushers away from the moving plugs at the downstream end of the vertical belt, a pair of rollers are disposed at the downstream end of the belt to guide the belt on an inclined plane relative to the second conveyor. This allows a gradual movement of a pusher from an engaged plug.

A suitable hold-down bar is also movably mounted above the lower run of the vertical belt for lightly pressing the plugs onto a strip of adhesive-containing mouthpiece paper.

During operation, a rod of entrainment-type filter material is fed through the ledger and is severed by the groups of knives of the cutter into individual plugs. These plugs are then ejected in a coarse spacing by the rotatable pin wheel onto the first conveyor. Thereafter, the plugs pass under the influence of the spacing means and are then accurately spaced apart and deposited onto a strip of mouthpiece paper which is fed onto the belt of the second conveyor. Thereafter, the belt and strip of mouthpiece paper are formed into a U-shape and fed under the wheel of the feed means. Immediately before injection of the granular filter material, the neck-down section of the garniture laterally compresses the plugs by necking down the U-shaped belt and paper. The charges of filter material are then ejected from the chambers of the wheel of the feed means in sequential order via the pins of the cam wheel. After injection, the mouthpiece paper is formed into an overlapped tube and a rod-shaped assembly of alternating plugs and granular filter material is formed by the sealing means. Thereafter, the second cutting means severs this rod-shaped assembly into, for example, six-up plugs for delivery to other processing equipment.

By increasing the number of cutting blades in each group of cutting blades of the initial cutting means, the output of the cutting means can be substantially increased, for example to 6,000 plugs per minute. In this respect, the rotatable pin wheel which is driven off the main drive of the apparatus rotates at a faster rate than the plug output ejects the plugs in a coarse spaced relationship.

By laterally compressing the plugs prior to injection of the granular filter material, the granular filter material can be more readily accepted without forming a void.

By using a cam wheel with projecting pins in the feed means to push the plungers for expelling the granular filter material, the filter material can be ejected in a controlled manner without abrupt acceleration to reduce shattering of the individual particles of the material.

These and other objects and advantages of the invention will become more apparent from the following detailed description taken in conjunction with the accompanying drawings wherein.

Figure 1:
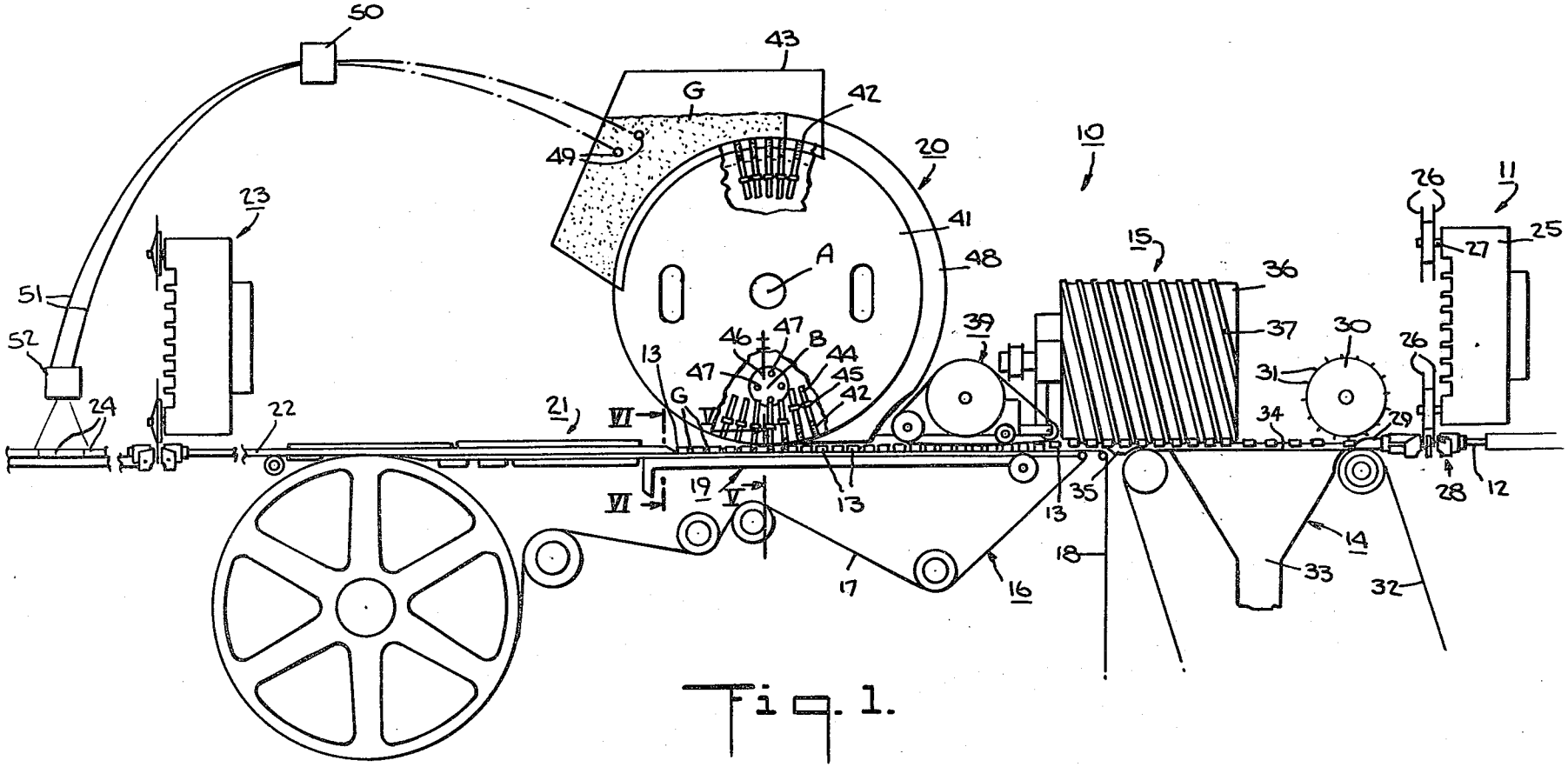
FIG. 1 illustrates a schematic side view of an apparatus constructed in accordance with the invention.

Referring to FIG. 1, the apparatus 10 for producing cigarette filter tip assemblies having multi-sectional construction includes a cutting means 11 for cutting a delivered rod 12 of entrainment-type filter material into disparate plugs 13, a conveyor 14 for receiving and conveying the cut plugs, means 15 for spacing the plugs 13 on the conveyor 14 relative to each other at predetermined spacings and a second conveyor 16. This second conveyor 16 has an endless belt 17 for receiving and conveying a strip of mouthpiece paper 18 with the spaced plugs 13 thereon along a predetermined path.

In addition, a garniture 19 cooperates with the conveyor 16 to deform the belt 17 and strip of mouthpiece paper 18 into a U-shaped about the plugs 13 for purposes as described below.

The apparatus 10 also has a feed means 20 above the conveyor 16 for feeding granular adsorptive-type filter material G into each determinate space between successive plugs 13 on the belt 17.

The apparatus 10 also has a suitable sealing means 21 for sealing the mouthpiece paper 18 on itself in order to form a rod-shaped assembly 22 of alternating sections of plugs 13 and granular material. A suitable cutting means 23 is also provided downstream of the sealing means 21 in order to sever the rod-shaped assembly 22 into filter plugs 24 of determinate length.

Referring to FIG. 1, the cutting means 11 is of generally known construction e.g. as described in U.S. Pat. No. 4,090,424 and includes a rotatable head 25 which is mounted via a shaft (not shown) on a fixed axis of rotation. In addition, the cutting head 25 carries two groups of co-extensive parallel knives 26. As indicated, the knives 26 are rotary cutting knives and are disposed in pairs at diametric points of the cutting head 25. Each pair of knives 26 is rotatably mounted on a suitable shaft 27 fixed to the cutter head 25.

The cutting means 11 cooperates with a reciprocal ledger 28 which receives the rod 12 of filter material from a suitable source (now shown). The ledger 28 e.g. as described in U.S. Pat. No. 4,909,424 has suitable intermediate recesses for passage of the rod 12 therethrough as well as for passage of each pair of knives 26. The cutting knives 26 for positioned to pass through the respective recesses of the ledger 28 to simultaneously cut two plugs 13 from the rod 12. The reciprocating motion of the ledger 28 and the rotatable motion of the head 25 are synchronized such that each pair of cutting knives 26 passes through the recesses as the knives 26 reach the lowermost position of the head 25 as indicated in FIG. 1 and as the ledger 28 moves into a forwardmost position. After the knives 26 pass through the ledger 28, the ledger 28 moves rearwardly. The continuous motion of the rod 12 and the relative rearward motion of the ledger 28 serves to position the cut plugs 13 at the forward end of the ledger 28. In this respect, the forward end or outlet of the ledger 28 is provided with a spring 29 to retain the plugs 13 in the ledger 28.

Referring to FIG. 1, a pin wheel 30 is rotatably mounted downstream of the ledger 28 and has radially projecting pins 31 for sequentially engaging and ejecting the cut plugs 13 from the ledger 28 onto the conveyor 14. In this respect, the speed of the pin wheel 30 is faster than the speed of the rod 12 so that the plugs 13 are pulled out of the ledger 28 under the force of the retaining spring 29. At the same time, the pins 31 of the wheel 30 mash down on the plugs 13 without penetrating in order to insure a firm transfer onto the conveyor 14.

The conveyor 14 is constructed of an endless perforated belt 32 which passes over a vacuum chamber 33 in known manner. The belt 32 receives the plugs 13 delivered by the pin wheel 30 and maintains the spacing of the plugs 13 during travel. The belt 32 is driven at a faster speed than the plug output to space the plugs 13 about one inch apart.

Figure 2:
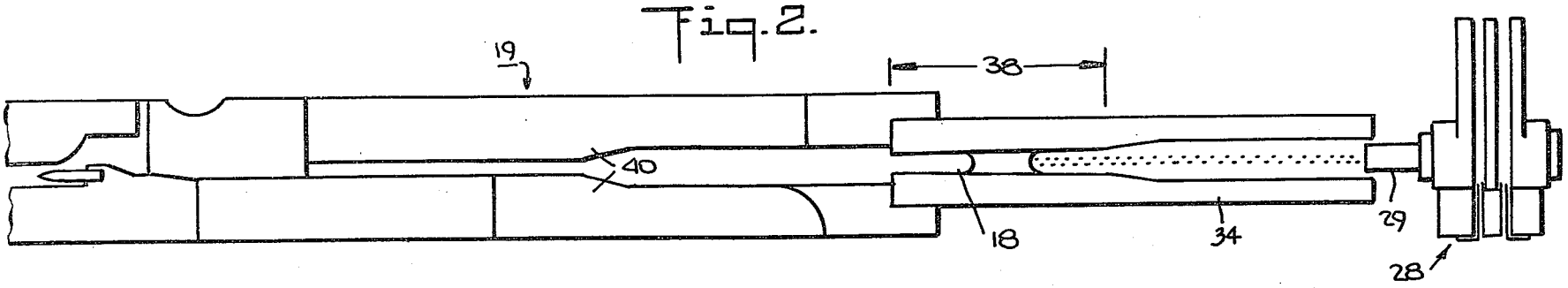
FIG. 2 illustrates a partial plan view of the apparatus of FIG. 1.
Figure 3:
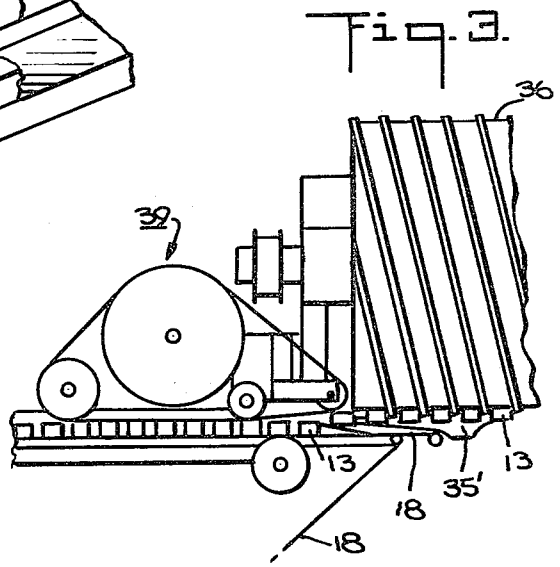
FIG. 3 illustrates a partial side view of the spacing means of the apparatus of FIG. 1 in accordance with the invention.

The means 15 for spacing the plugs 13 on the conveyor 14 at a predetermined spacing includes a trough 34 (FIG. 2) which extends between the conveyors 14, 16 for guiding the plugs 13, a bridge 35 which bridges a gap between the conveyors 14, 16 and a rotatable drum 36 which is mounted on a horizontal axis over the conveyors 14, 16, trough 34 and bridge 35. The drum 36 includes a flight 37 which has turns disposed at predetermined spacings to engage the rear end of each plug 13 to push the plugs 13 onto the conveyor 16 at precise spacings from each other. To this end, the drum 35 cooperates with a narrowed section 38 of the trough which begins at an intermediate part of the trough and engages the sides of the filter plugs 13 in order to slow the movement of the plugs 13 prior to entry onto the conveyor 16. Due to the deceleration of the plugs 13, the plugs 13 are caused to move positively against the flight 37 of the drum 36 so that a precise spacing of the plugs 13 relative to each other is assured on the conveyor 16. For example, the flight 37 may have windings spaced to provide a spacing of 20 millimeters from back surface to back surface of adjacent plugs 13.

The conveyor 16 is of conventional construction. In order to maintain the position of the plugs on the paper 18 being conveyed by the belt 17, a suitable hold-down means 39 is disposed above the conveyor 16 adjacent to the drum 36. This hold-down means 39 is similar to that as described in U.S. Pat. No. 3,357,321 and need not be further described. The mouthpiece paper 18 may also be provided with a hot melt adhesive in order to hold the plugs 13 in a position during travel.

Figure 4:
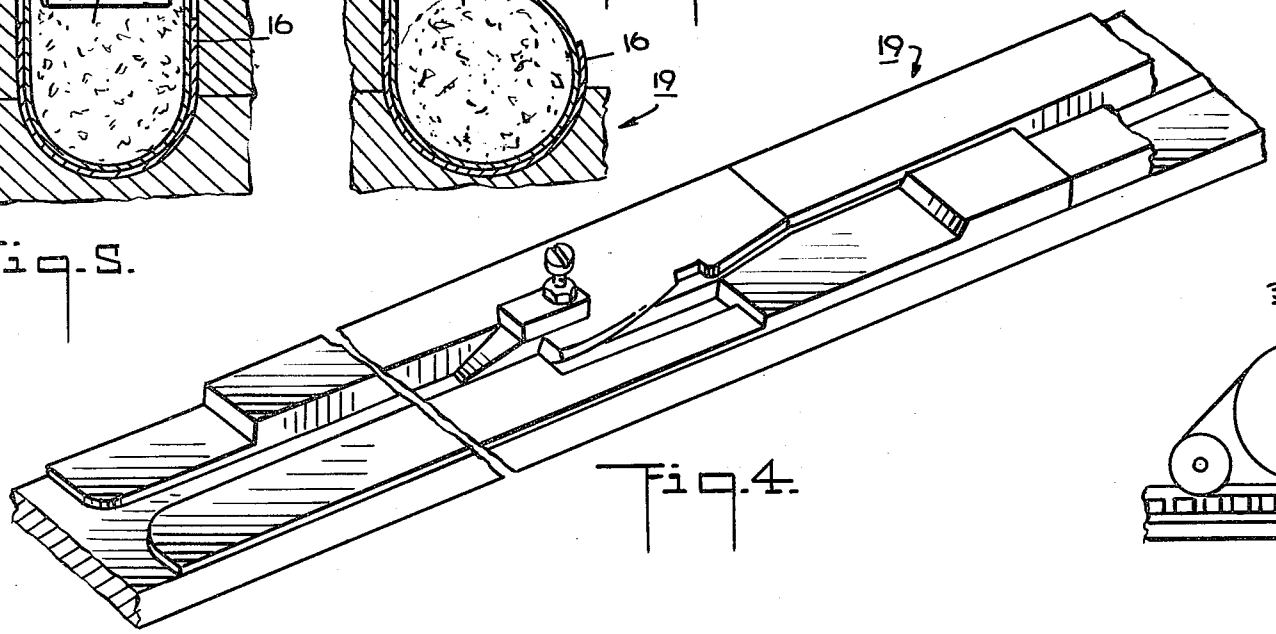
FIG. 4 illustrates a garniture constructed in accordance with the invention.
Figure 5:
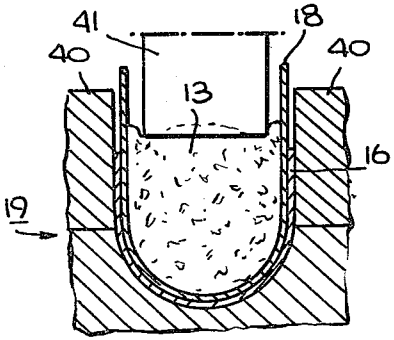
FIG. 5 illustrates a cross-sectional view taken on line V—V of FIG. 1.
Figure 6:
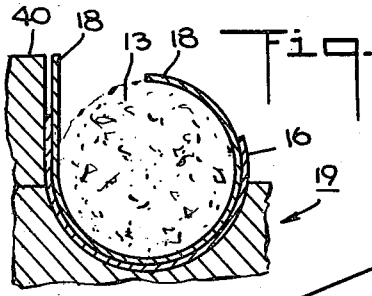
FIG. 6 illustrates a cross-sectional view taken on line VI—VI of FIG. 1.

Referring to FIGS. 1 and 4, the garniture 19 is of generally known construction and serves to guide the belt 17 and mouthpiece paper 18 therein. To this end, the garniture 19 has a first section near the inlet end for forming the belt 17 and the mouthpiece paper 18 into a U-shape (see FIG. 5). This provides a trough-like shape for subsequently receiving granular filter material between the spaced apart plugs 13. The garniture 19 also has a following neck-down section wherein the walls 40 of the garniture 19 deform the belt 17 and mouthpiece paper 18 and laterally compress the plugs 13 to form a chamber or pocket between adjacent plugs 13 of constricted shape for receiving the granular filter material. For example, for a plug having a nominal radius of 5/32 inches, the walls 40 of the garniture 19 laterally compress each plug about 1/32 inches on each side. The garniture 19 also has a folding section (see FIG. 6), as is known, for forming the strip of mouthpiece paper 18 into an overlapped tube after the granular filter material has been received between the plugs 13.

The feed means 20 includes a rotary feed wheel 41 which is rotatable about a fixed axis A above the neck-down section of the garniture 19. The wheel 41 includes a rotatable body of generally known construction having a plurality of circumferentially spaced radial chambers 42 for receiving charges of granular filter material G from a suitable supply hopper 43 located above the wheel 41. In addition, the feed wheel 41 has a plurality of plungers 44, each of which is slidably mounted in a respective chamber 42. Each plunger 44 also has a collar 45 thereon which cooperates with a suitable cam (not shown) so that the plungers 44 can be retracted relative to the chambers 42 to leave the chambers 42 free to receive filter material G from the hopper 43.

In addition, the rotary feed wheel 41 has a cam wheel 46 rotatably mounted on a fixed axis B parallel to and below the axis A of the feed wheel 41. The cam wheel 46 is rotatable independently of the feed wheel 41 and has a plurality of circumferentially spaced pins 47, e.g. four, for sequentially engaging the plungers 44. The pins 47 push the plungers 44 into the chambers to expel the filter material G therein into the spaces between successive pairs of filter plugs 13 on the garniture 19.

The speed of the cam wheel 46 is synchronized with the speed of the rotary feed wheel 41 such that each pin 47 abuts or engages against a plunger 44 at a point at about a 4 o'clock position of the cam wheel 46. As the cam wheel 46 rotates, the pin 47 forces the plunger 44 radially outwardly within the chamber 42 so that the filter material in the chamber 42 is expelled at a gradually increasing rate. Completion of the discharge of the filter material occurs when the pin 47 is at a 6 o'clock position of the cam wheel 46, i.e. at a bottom dead center of the cam wheel 46 and rotary feed wheel 41. Each pin 47 thus walks with a plunger 44 to push the filter material out of the respective chamber 42. Thus, the filter material is not expelled in a manner to shatter the individual particles of the filter material. Instead, the discharge of the material is relatively gradual so that the space between two adjacent plugs 13 receives a substantially uniform charge of filter material. Further, because the space between two plugs 13 has been laterally compressed, by the walls 40 of the garniture 19, a more complete filling of the space between the plugs 13 is achieved.

The feed wheel 41 is also provided with a suitable cam (not shown) for retracting the plungers at about an 8 o'clock position of the feed wheel 41 and a shroud 48 to retain the charges of filter material G in the chambers 42 during travel from below the hopper 43 to the discharge position beginning at the end of the shroud 48. This shroud 48 may be made of a harder material than the filter material so as to avoid scratching of the shroud 48.

The sealing means 21 is of conventional construction and serves to seal the overlap strip of mouthpiece paper 18 to itself to form a rod-shaped assembly 22 of alternating sections of plugs 13 and granular filter material G. The sealing means 21 is otherwise known and need not be further described.

The cutting means 23 for severing the rod-shaped assembly 22 is also of known construction and need not be further described. However, it is to be noted that the cutting means 23 may be synchronized to operate at speeds which provide filter plugs 24 of two-up, four-up or six-up construction.

In addition, a suitable sensing means can be provided for detecting and discharging improperly made plugs. For example, a vacuum catcher can be provided with two electrical probes 49 in the supply hopper 43 to detect when the level of material G in the hopper 43 drops below a certain level. Upon sensing this, a suitable signal is directed to a solenoid 50 which, in turn, delivers pneumatic pulses via air lines 51 to a reject nozzle 52 for expelling a plug 46 which does not contain a sufficient amount of granular filter material.

During operation, a rod 12 of entrainment-type filter material is fed through the ledger 28 and is severed by the groups of knives 26 of the cutter 11 into individual plugs 13. These plugs 13 are then ejected in a coarse spacing by the rotatable pin wheel 30 onto the perforated belt 33 of the vacuum conveyor 14. Thereafter, the plugs 13 pass under the spacing drum 36 and are somewhat retarded in movement by the narrowed section of the trough 34 so as to be abutted against the flight 37 of the drum 36. The plugs 13 are then accurately spaced apart and deposited onto a strip of mouthpiece paper 18 which is fed onto the belt 17 of the second conveyor 16. Thereafter, the belt 17 and strip of mouthpiece paper 18 are formed into a U-shape (see FIG. 5) and fed under the wheel 41 of the feed means 40. Immediately before injection of the granular filter material 13, the neck-down section of the garniture 19 laterally compresses the plugs 13 by necking down the U-shaped belt and paper. The charges of filter material are then ejected from the chambers of the wheel 41 in sequential order via the pins 47 of the cam wheel 48. After injection, the mouthpiece paper 18 is formed into an overlapped tube and a rod-shaped assembly 22 of alternating plugs and granular filter material is formed by the sealing means 21. Thereafter, the second cutting means 23 severs this rod-shaped assembly into, for example, six-up plugs for delivery to other processing equipment.

The apparatus can be used to produce six-up plugs and the like at relatively high rates of output. For example, with the cutting head 25 rotating at a speed of 1500 revolutions per minute, 6,000 plugs 13 can be delivered onto the conveyor 14.

Further, with the relatively gradual discharge of the granular filter material G into the spaces between the filter plugs 13 and the lateral compressing of the filter plugs 13, the spaces between the filter plugs 13 can be fully packed with the granular filter material G. Further, the filter material G is not scattered nor shattered so that fines are not produced which may otherwise settle within the filter plugs or subsequently made filter tip assemblies.

It is also noted that the use of the cam wheel 46 allows the angle over which the granular filter material G is discharged to be increased so that the actual discharge of the material is carried out without abrupt acceleration of the charge.

After the granular filter material G has been discharged, the garniture 19 forms the plugs 13 to the diameter desired. At the same time, the spaces between the plugs 13 in which the granular filter material is received is also shaped to the same diameter with the granular filter material filling all of the cross-section.

Figures 7, 8:
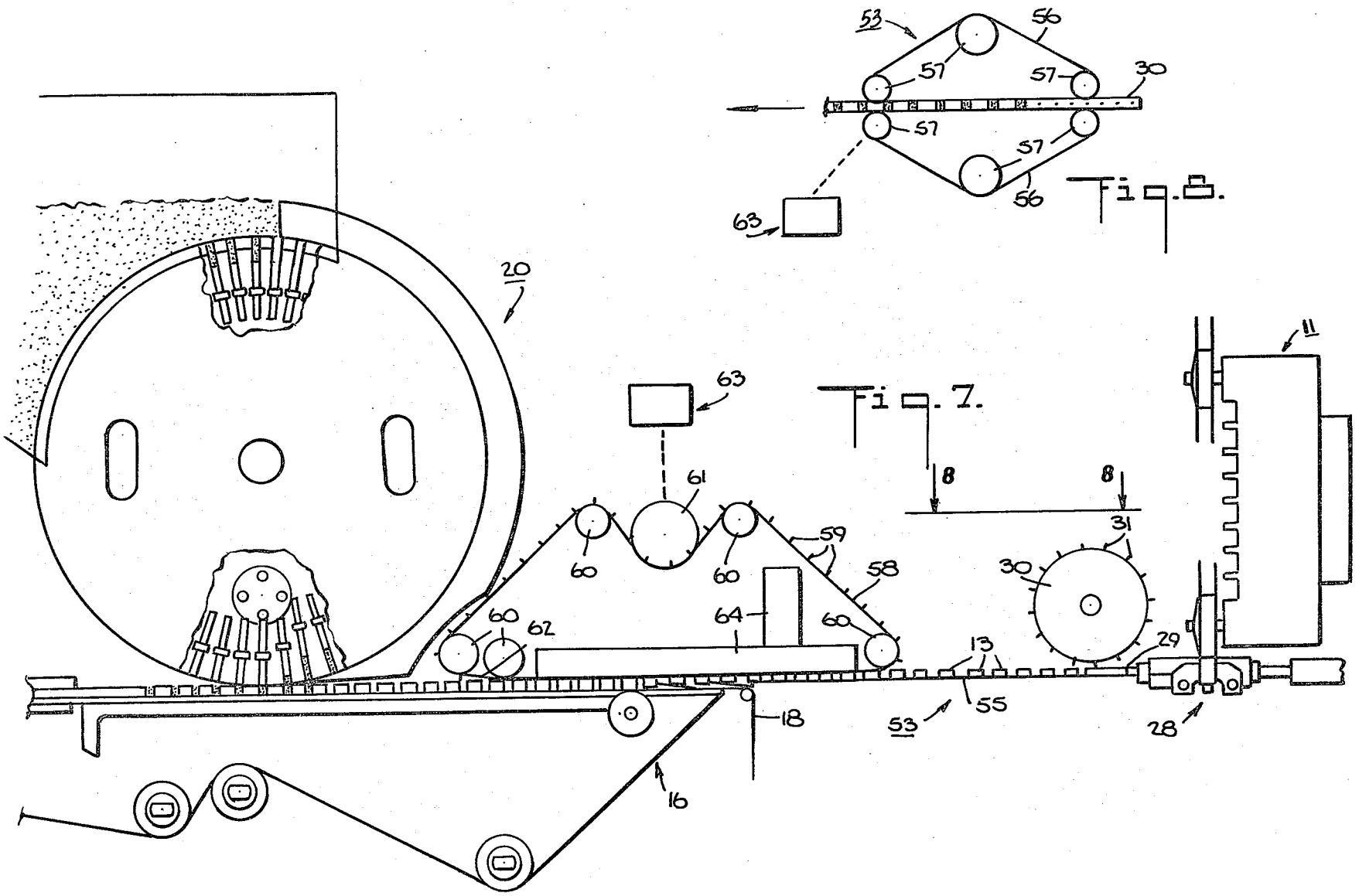
FIG. 7 illustrates a partial schematic side view of a modified apparatus constructed in accordance with the invention.
FIG. 8 illustrates a view taken on line 8—8 of FIG. 7.

Referring to FIG. 7, wherein like reference characters indicate like parts as above, the first conveyor 53 downstream of the cutting means 11 and the spacing means 54 can be constructed in alternative manners. For example, as shown in FIGS. 7 and 8, the conveyor 53 includes a horizontally disposed bottom support 55 which extends from under the outlet of the ledger 28 and a pair of horizontally disposed endless belts 56 which are aligned with the pin wheel 30. The belts 56 are in the form, for example, of timing belts, and serve to convey the plugs 13 therebetween and along the bottom support 55 in spaced relation, e.g. about one inch apart. To this end, the belts 56 are driven at the same speed as the pin wheel 30. As shown in FIG. 8, the belts 56 are looped about various guide rollers 57 at least one of which also functions as a drive roller.

The spacing means 54 includes a vertically disposed endless belt 58, e.g. a timing belt, which is aligned with the bottom support 55 and the belts 56. This belt 58 carries a plurality of spaced apart pushers 59, such as teeth, for pushing the plugs 13 from the bottom support 55 to the conveyor 16 in predetermined spaced relation. To this end, the pushers 59 are spaced apart, e.g. 20 millimeters, so as to provide a space between the plugs 13 of 6 millimeters where the plugs 13 are of a length of 14 millimeters.

As shown, the belt 58 is looped about various guide rollers 60 and is driven by a drive roller 61. The upstream end of the belt 58 extends between the downstream end of the belts 56 such that the axis of rotation of the upstream guide roller 60 is in the same plane as the axis of rotation of the downstream guide rollers 57 of the conveyor 53. In this way, the belt 58 begins to push a plug 13 from the conveyor 53 while the plug 13 is still retained between the belts 56. This allows each plug 13 to be engaged by a pusher 59 and accurately spaced from the plug ahead.

The guide rollers 60 at the downstream end of the belt 58 are disposed in a pair for guiding the belt 58 on an inclined plane 62 relative to the conveyor 16 so as to allow the pushers 59 to gradually move away from an engaged plug 13 moving on the conveyor 16. As shown, the downstream-most roller 60 of the pair is disposed in a higher plane than the other roller 60 of the pair.

The belts 56 of the conveyor 53 and the belt 58 of the spacing means 54 are driven in timed relation to each other by a suitable transmission means 63 (shown schematically). To this end, the surface speed of the belt 58 is equal to the surface speed of the mouthpiece paper 18 on the conveyor 16.

Referring to FIG. 7, a hold-down bar 64 is disposed above the conveyor 16 and a lower run of the belt 58 for lightly pressing the conveyed plugs 13 onto the hot melt adhesive on the mouthpiece paper 18. In this respect, the bar 64 is movably mounted, e.g. via a hinge pin (not shown) so as to be pivoted upwardly for cleaning and maintenance purposes.

If required, a bridge may be disposed between the bottom support 55 and the conveyor 16, i.e. the strip of mouthpiece paper 18 delivered to the conveyor 16, in order to facilitate movement of the plugs 13 from the conveyor 53 to the conveyor 16.

The operation of the latter embodiment is similar to the embodiment of FIGS. 1 to 6 and need not be further described.

The invention thus provides an apparatus in which filter tips of granular-type multi-sectional construction can be assembled at relatively high speed without shattering of the granular filter material.

The invention also provides an apparatus in which the chambers between two filter plugs can be fully packed with granular filter material.

What is claimed is:

1. An apparatus for the production of cigarette filter tip assemblies having multi-sectional construction, said apparatus comprising a flat cutting means for cutting a delivered rod of entrainment type filter material into disparate plugs;

a first conveyor for receiving and conveying the cut plugs from said cutting means;

means for spacing the plugs on said first conveyor relative to each other at predetermined spacings;

a second conveyor having an endless belt for receiving and conveying a strip of mouthpiece paper with the spaced plugs thereon along a predetermined path;

a garniture having a first section in said path for forming said belt and the mouthpiece paper into a U-shape, a following neck-down section for laterally compressing the plugs and a folding section for forming the strip of mouthpiece paper into an overlapped tube;

feed means above said second conveyor and said neck-down section of said garniture for feeding granular absorptive-type filter material into each determinate space between successive plugs on said belt, said feed means including a wheel rotatably mounted on a first axis and having a plurality of circumferentially spaced radial chambers for receiving granular absorptive-type filter material therein, a plurality of plungers, each said plunger being slidably mounted in a respective chamber and a cam wheel rotatably mounted on a second axis parallel to said first axis and having a plurality of circumferentially spaced pins for sequentially engaging said plungers at an initial position spaced before the bottom dead center portion of said plungers to gradually push said plungers into said respective chambers to expel the granular filter material therein at a point above said neck-down section of said garniture;

sealing means for sealing the overlapped strip of mouthpiece paper to form a rod-shaped assembly of alternating sections of plugs and granular filter material; and a second cutting means for severing the rod-shaped assembly into filter plugs of determinate length.

2. An apparatus as set forth in claim 1 which further comprises a reciprocal ledger for receiving the delivered rod of filter material and cooperating with said first cutting means to position a cut plug of filter material at a predetermined position at a forward end of said ledger; and a rotatable pin wheel having radially projecting pins for sequentially engaging and ejecting cut plugs at said forward end of said ledger onto said first conveyor in spaced apart relation.

3. An apparatus as set forth in claim 1 wherein said first cutting means includes at least one group of coextensive parallel knives for cutting the delivered rod simultaneously to form a multiplicity of cut plugs of filter material.

4. An apparatus as set forth in claim 3 wherein each group of knives includes a pair of rotary cutting knives and said cutting means operates at a speed of six thousand plugs per minute.

5. An apparatus as set forth in claim 1 which further comprises a trough between said first conveyor and said second conveyor for guiding the plugs under said means for spacing, said trough having a narrowed section for slowing the movement of the plugs prior to entry onto said second conveyor.

6. An apparatus as set forth in claim 5 wherein said means for spacing is a rotatable drum having at least one flight thereon for pushing the plugs from said first conveyor through said narrowed section of said trough onto said second conveyor.

7. An apparatus as set forth in claim 1 wherein said first conveyor includes a bottom support and a pair of horizontally disposed endless belts for conveying the cut plugs therebetween and along said bottom support in spaced relation.

8. An apparatus as set forth in claim 7 wherein said means for spacing includes a vertically disposed endless belt aligned with said bottom support and having a plurality of spaced apart pushers thereon for pushing the cut plugs from said bottom support to said second conveyor in predetermined spaced relation.

9. An apparatus as set forth in claim 8 which further comprises means for driving said horizontally disposed belts and said vertically disposed belt in timed relation to each other.

10. In an apparatus for the production of cigarette filter tips of multi-sectional construction, the combination comprising a reciprocal ledger for receiving a rod of filter material;

a cutting means having a rotary cutting head with at least one pair of coextensive parallel knives for cutting a rod in said ledger simultaneously to form pairs of cut plugs of filter material;

a conveyor for receiving a series of cut plugs from said ledger; and a rotatable pin wheel having radially projecting pins for sequentially engaging on the cut plugs of filter material on a forward end of said ledger to eject the cut plugs from said ledger onto said conveyor.

11. In an apparatus for the production of cigarette filter tips of multi-sectional construction, the combination comprising a first conveyor for conveying a series of spaced apart plugs of filter material thereon;

a second conveyor for receiving the series of plugs from said first conveyor;

a trough between said conveyors for guiding the plugs therebetween, said trough having a narrowed section beginning at an intermediate part for slowing the movement of the plugs from said first conveyor towards said second conveyor; and a rotatable drum above said conveyors having at least one flight thereon for pushing the plugs from said first conveyor through said narrowed section of said trough onto said second conveyor.

12. In an apparatus for the production of cigarette filter tips of multi-sectional construction, the combination comprising a first conveyor for conveying a series of spaced apart plugs of filter material thereon, said conveyor including a bottom support and a pair of horizontally disposed endless belts for conveying the plugs therebetween and along bottom support in spaced relation;

a second conveyor for receiving the series of plugs from said first conveyor; and spacing means above said conveyors having a vertically disposed endless belt aligned with said bottom support and having a plurality of spaced apart pushers thereon for pushing the plugs from said bottom support onto said second conveyor, said spacing means including a pair of rollers at a downstream end of said vertically disposed belt for guiding said latter belt therebetween on an inclined plane relative to said second conveyor to gradually move a respective pusher from an engaged plug moving on said second conveyor.

13. In an apparatus as set forth in claim 12, a movably mounted hold down bar disposed above said second conveyor and a lower run of said vertically disposed belt for lightly pressing the conveyed plugs onto a strip of adhesive-containing mouthpiece paper conveyed on said second conveyor.

14. In an apparatus for the production of cigarette filter tips of multi-sectional construction, the combination comprising a garniture having a first section for forming an endless belt and a strip of paper thereon into a U-shape, a following neck-down section to laterally compress spaced apart plugs of filter material within the U-shaped belt and paper, and a folding section for forming the paper into an overlapped tube; and a wheel rotatably mounted on a first axis above said neck-down section of said garniture, said wheel having a plurality of circumferentially spaced radial chambers for receiving granular absorptive-type filter material therein, a plurality of plungers, each said plunger being slidably mounted in a respective chamber and a cam wheel rotatably mounted on a second axis parallel to said first axis and having a plurality of circumferentially spaced pins for sequentially engaging said plungers at an initial position spaced before the bottom dead center portion of said plungers to gradually push said plungers into said respective chambers to expel the granular filter material therein at a point above said neck-down section of said garniture.

15. A rotary feed wheel for a cigarette filter tip making machine, said wheel comprising a rotatable body mounted on a first axis and having a plurality of circumferentially spaced radial chambers for receiving granular absorptive-type filter material therein;

a plurality of plungers, each said plunger being slidably mounted in a respective chamber; and a cam wheel rotatably mounted on a fixed axis parallel to said first axis, said cam wheel having a plurality of circumferentially spaced pins for sequentially engaging said plungers at an initial position spaced before the bottom dead center portion of said plungers to gradually push said plungers into said respective chambers to expel the filter material therein.

16. A rotary feed wheel as set forth in claim 15 wherein said cam wheel has four projecting pins.

17. A rotary feed wheel as set forth in claim 15 wherein each said pin disengages from a respective plunger at a point corresponding to a bottom dead center point of said respective plunger.

* * * * *

UNITED STATES PATENT AND TRADEMARK OFFICE

CERTIFICATE OF CORRECTION

PATENT NO. : 4,411,640

DATED : October 25, 1983

INVENTOR(S) : Floyd V. Hall

It is certified that error appears in the above—identified patent and that said Letters Patent is hereby corrected as shown below:

Col. 5, line 29, change "4,909,424" to --4,090,424--.

Signed and Sealed this

Tenth Day of January 1984

[SEAL]

*Attest:*

GERALD J. MOSSINGHOFF

*Attesting Officer*

*Commissioner of Patents and Trademarks*